US006733280B1

(12) United States Patent
Livne et al.

(10) Patent No.: US 6,733,280 B1
(45) **Date of Patent: *May 11, 2004**

(54) GIFT ITEM CANDLE WITH FALLING SECTIONS

(76) Inventors: Oren Livne, 6021 Avila Ave., El Cerrito, CA (US) 94530; Amanda Caroline Johnson, 1410 B Bay St., Alameda, CA (US) 94501

( * ) Notice: Subject to any disclaimer, the term of this patent is extended or adjusted under 35 U.S.C. 154(b) by 0 days.

This patent is subject to a terminal disclaimer.

(21) Appl. No.: 10/284,554

(22) Filed: Nov. 1, 2002

Related U.S. Application Data

(62) Division of application No. 09/626,847, filed on Jul. 27, 2000, now Pat. No. 6,511,313.
(60) Provisional application No. 60/146,481, filed on Jul. 30, 1999.

(51) Int. Cl.[7] ..... F23D 3/16; F21V 35/00; C11C 5/00
(52) U.S. Cl. ..... 431/288; 431/289; 431/126
(58) Field of Search ..... 431/288, 289, 431/325; 362/160, 161

(56) References Cited

U.S. PATENT DOCUMENTS

| | | | | | |
|---|---|---|---|---|---|
| 1,551,104 | A | * | 8/1925 | Hawley | 431/288 |
| 1,554,524 | A | * | 9/1925 | Rhodes | 431/125 |
| 1,676,137 | A | * | 7/1928 | Dodge | |
| 2,196,509 | A | * | 4/1940 | Turner | 431/295 |
| 2,308,738 | A | * | 1/1943 | Baur et al. | 431/126 |
| 2,735,285 | A | * | 2/1956 | Ferleger | 431/288 |
| 2,812,652 | A | * | 11/1957 | Conley | 431/126 |
| 2,974,509 | A | * | 3/1961 | Penke | 431/288 |
| 4,696,640 | A | | 9/1987 | Pitchford | |
| 5,395,233 | A | * | 3/1995 | Karp | 431/126 |
| 5,492,664 | A | | 2/1996 | Cutts | |
| 5,567,145 | A | * | 10/1996 | White | 431/288 |
| 5,697,694 | A | | 12/1997 | Cutts | |
| 5,798,184 | A | * | 8/1998 | Sasa et al. | 431/288 |
| 5,879,153 | A | | 3/1999 | Slejertin | |
| 6,511,313 | B1 | * | 1/2003 | Livne et al. | 431/288 |

FOREIGN PATENT DOCUMENTS

| | | | | |
|---|---|---|---|---|
| DE | 1061020 | * | 7/1958 | 431/288 |
| DE | 40 16 007 | * | 11/1991 | |
| DE | 4016007 | * | 11/1991 | 431/289 |
| DE | 19548365 | * | 7/1997 | 431/289 |
| GB | 1370178 | * | 10/1974 | 431/288 |
| GB | 2196017 | * | 4/1988 | |
| WO | WO 95/09222 | * | 4/1995 | |
| WO | WO-95/09222 | * | 4/1995 | 431/289 |

OTHER PUBLICATIONS

"The COMPLETE candlemaker", Norma Coney, Lark Books, New York, 1997, pp. 98–101.*
"Great CANDLES", Stewart D'Hyder, Sterling Publishing Co., Inc., 1997.*
Great Candles, Stewart D'Arcy Hyder, Sterling Publishing Co., Inc., 1997, pp. 44–46.*
The Complete Candlemaker, Norma Coney, Lark Books, 1997, pp. 98–101.*
Candles Plus Web Page printed Jul. 5, 2000, http://www.candlesplus.com/beeswax.html.

(List continued on next page.)

*Primary Examiner*—Carl D. Price
(74) *Attorney, Agent, or Firm*—Oren Livne

(57) ABSTRACT

The present invention discloses a class of candles comprised of attached sections that fall away as the candle is burned. In a basic embodiment a novelty candle has a wick embedded in a wax core. Several attachments are connected to the core. The attachments are shaped, weighted, and placed such that they would tend to fall down and outward if not for their connection to the core. The falling process is initiated by lighting the wick. Heat from the flame causes the attachments to disconnect from the core and subsequently fall and rest on a table or other surface. Once the attachments have fallen, portions of the core previously hidden are revealed.

20 Claims, 15 Drawing Sheets

OTHER PUBLICATIONS

American Candle Classics Web Page, printing date and address unknown.
American Candle Classics Web Page, printed Jul. 5, 2000 http://www.americancandleclassics.com/traditional.htm.
Great Candles, Stewart D'Arcy Hyder, Sterling Publishing Co., Inc., 1997, pp. 44–46.
The Complete Candlemaker, Norma Coney, Lark Books, 1997, pp. 98–101.
Candles Plus Web Page printed Jul. 5, 2000 http://www.candleplus.com/beeswax.html.

American Candle Classics Web Page, printing date unknown address unknown.

American Candle Classics Web Page printed Jul. 5, 2000 http://www.americancadleclassics.com/traditional.htm.

* cited by examiner

GIFT ITEM CANDLE WITH FALLING SECTIONS

CROSS-REFERENCE TO RELATED APPLICATIONS

This patent application is a divisional of application Ser. No. 09/626,847 filed on Jul. 27, 2000 now issued as U.S. Pat. No. 6,511,313, which claims priority under 35 U.S.C Section 119(e) to U.S. Provisional Patent Application No. 60/146,481 filed on Jul. 30, 1999, entitled "CANDLE WITH FALLING SECTIONS" by Oren Livne et al, both of which are incorporated by reference herein.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of Invention

This invention relates to candles, more specifically to candles in which the burning process causes a desired change in candle shape.

2. Description of Related Art

There are a number of candle designs that use the burning process to produce a desired change in candle shape. Foliating candles gradually form leaf-like structures that droop to the candle's sides. Generally, foliating candles are solid wax cylinders containing a single wick. As the candle burns it splits down the middle and the two resulting sides bend down and outward, forming leaf-like structures. A special type of wax, known as foliating wax, is used for this drooping process. Other candles, known as feathered-twist candles, are designed so that finger-like structures encircle the flame as the candle burns. Feathered-twist candles are generally taper candles that have been specially shaped and twisted. The shaping and twisting process results in several thin fin-shaped extensions that spiral up the entire length of the candle. Each of these fin-shaped extensions develops into a single finger-like structure. Other examples of candles that change shape while burning are seen in U.S. Pat. No. 2,974,509 and U.S. Pat. No. 1,554,524. U.S. Pat. No. 2,974,509 discloses a candle comprised of a series of wax petals that open gradually and successively as the candle burns, simulating the opening of a flower. U.S. Pat. No. 1,554,524 discloses a flower candle in which wax petals tend to bend outward when heated, simulating a wilting flower.

Another category of designs related to the present invention includes candles where a wax shell surrounds a burnable core. For example, U.S. Pat. No. 2,735,285 discloses an ornamental candle comprised of a core burning element surrounded by a lantern-like shell. The core melts away leaving the majority of the shell intact. The shell can then be reused simply by replacing the core. U.S. Pat. No. 5,492,664 and U.S. Pat. No. 5,697,694 disclose a glowing orb candle that improves upon the design of U.S. Pat. No. 2,735,285. The improved candle has a reusable shell that remains completely intact.

Another design of particular interest is disclosed in U.S. Pat. No. 2,196,509. This patent describes a candle with diverging wick-containing branches that spring from common points of intersection. The wicks burn with distinct flames until they join together at the points of intersection.

Candles in which a non-melting nonflammable component is embedded in a meltable material (e.g. wax) are disclosed in U.S. Pat. No. 4,696,640 and U.S. Pat. No. 5,879,153. U.S. Patent No. 4,696,640 describes a solid candle that has an object, such as a horoscope or message, embedded in its interior. The object is revealed as the opaque wax melts away. U.S. Pat. No. 5,879,153 describes a candle comprised of an exterior meltable material surrounding an interior non-meltable body, such as the skeleton of a human hand. One or more wicks are used to melt away the exterior revealing the interior object.

While the prior art does disclose candles with sections that bend away as the candle burns it does not disclose candles with sections that fall off or fall away rapidly. The prior art does include candles with shell-like structures but none where those shell-like structures fall away. The prior art also includes candles with multiple wicks but none where the multiple wicks are used to detach sections. The prior art includes gift-item candles where the gift items are encased in wax and the wax must mostly melt away to reveal the object. However, the prior art does not include candles where the gift item is revealed as a result of sections falling away.

SUMMARY OF THE INVENTION

The present invention discloses a class of candles with sections that fall away as the candle is burned. The act of falling away can reveal previously hidden structures and/or result in interesting motions. The fallen sections can act as independent candles.

Accordingly, several objects of our invention are:

(a) to provide a candle structure with sections that fall away as the candle bums;

(b) to provide a candle that develops into multiple burning candles;

(c) to provide a candle structure such that hidden components are revealed as the candle burns;

(d) to provide a candle consisting of attached sections that fall to reveal a gift item;

(e) to provide a means for producing candles with changing scent combinations;

Further objects of our invention will become apparent from consideration of the ensuing drawings and descriptions.

BRIEF DESCRIPTION OF DRAWINGS

First embodiment

Bottom attachment means

Figure 1:
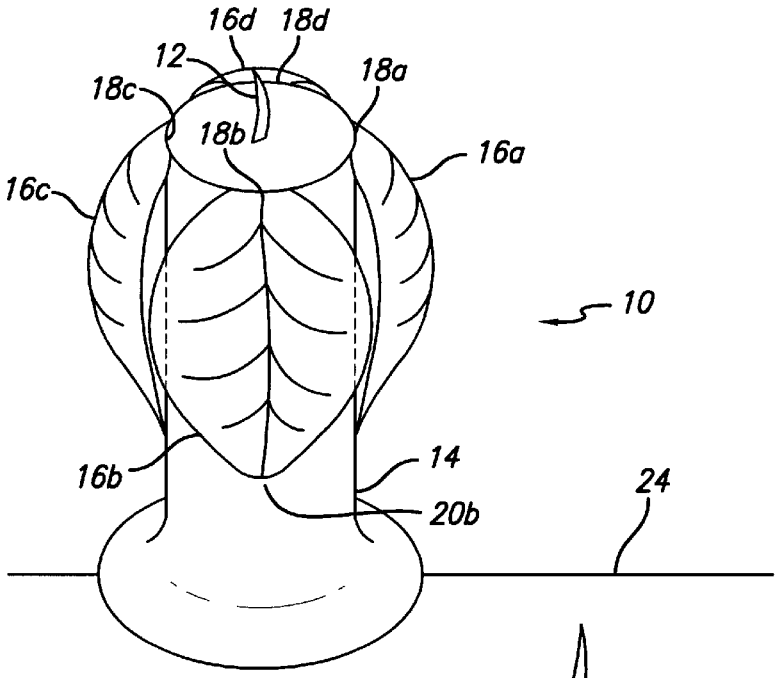
FIG. 1 depicts a novelty candle comprising a core with four attachments.
Figure 3:
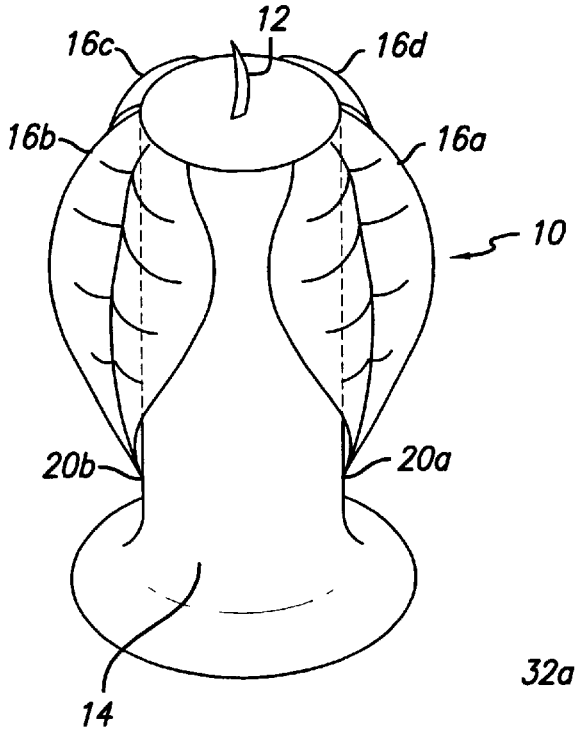

FIG. 3 depicts bottom contact points of FIG. 1 where the attachments rest against the core without any direct bond.

Figure 4:
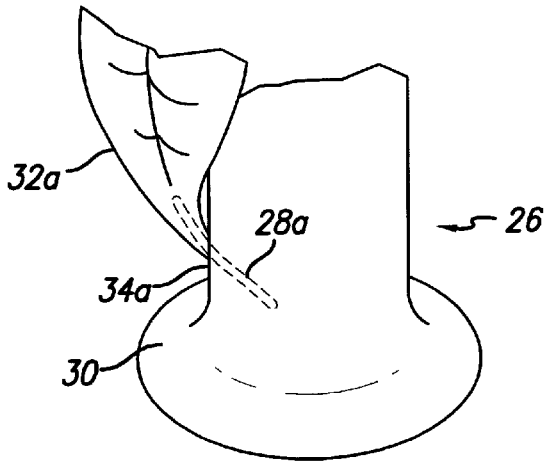

FIG. 4 depicts a bottom contact point where an embedded wick is used to secure an attachment to the core.

Figure 5:
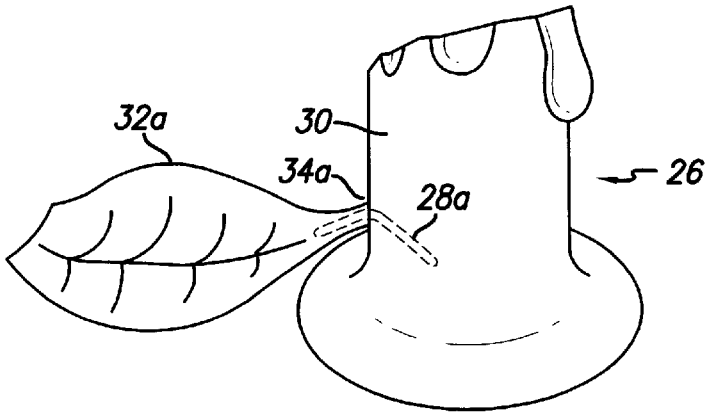

FIG. 5 depicts the attachment of FIG. 4 after the attachment has fallen.

Figure 6:
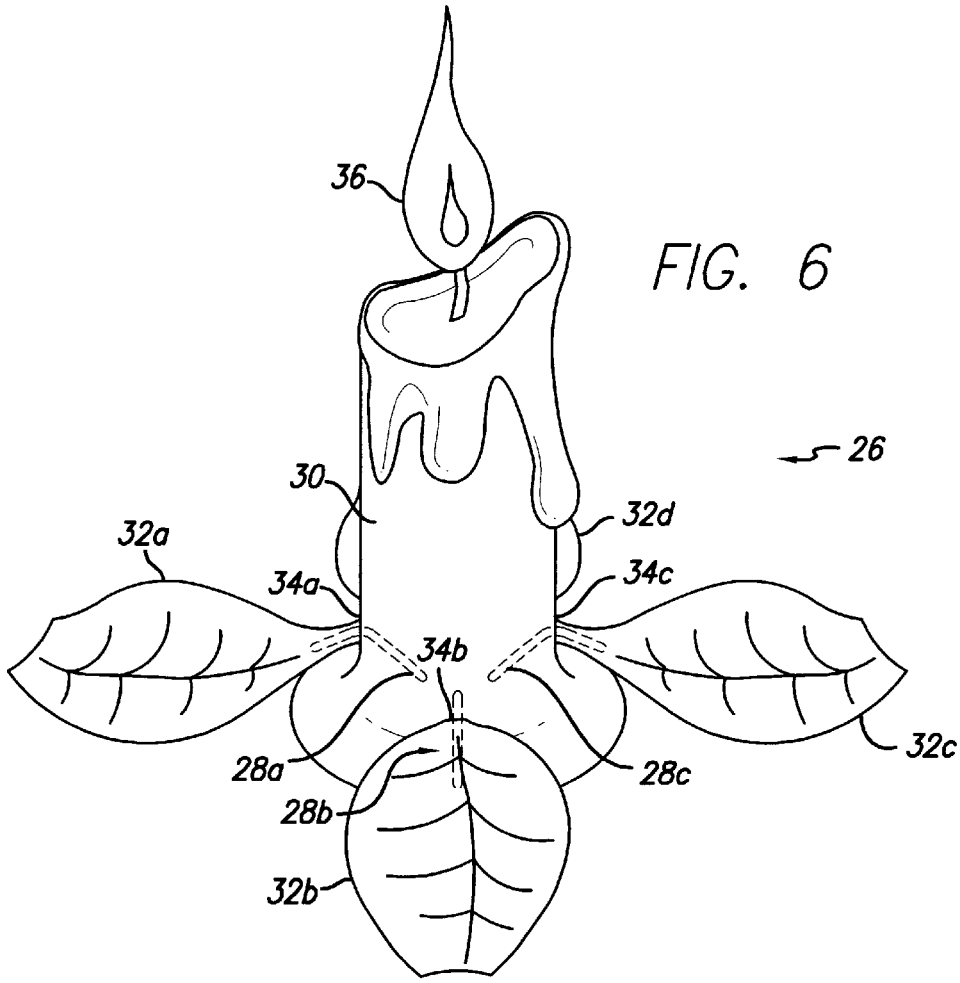

FIG. 6 depicts four fallen attachments like that in FIG. 5.

Figure 7:
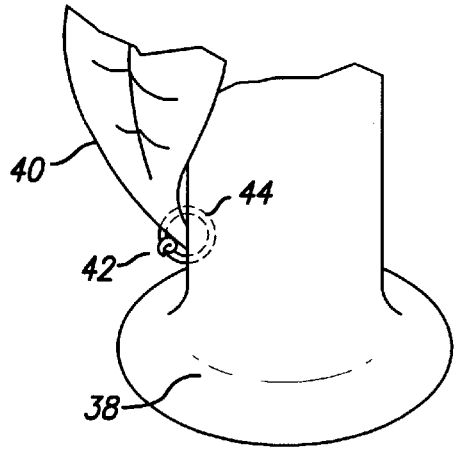

FIG. 7 depicts a bottom contact point where a string loop is used to secure an attachment to the core.

Top Attachment Means

Wax bond

Figure 8:
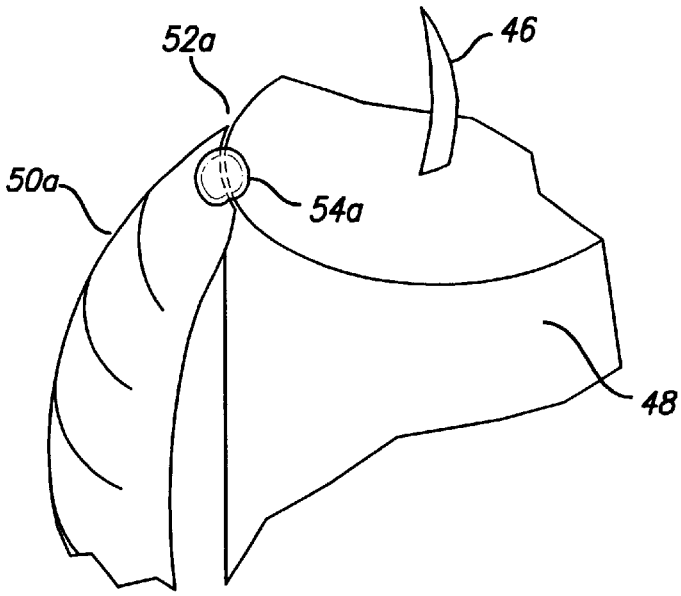

FIG. 8 depicts a top attachment point where a wax bond is used to secure an attachment to the core.

Figure 9:
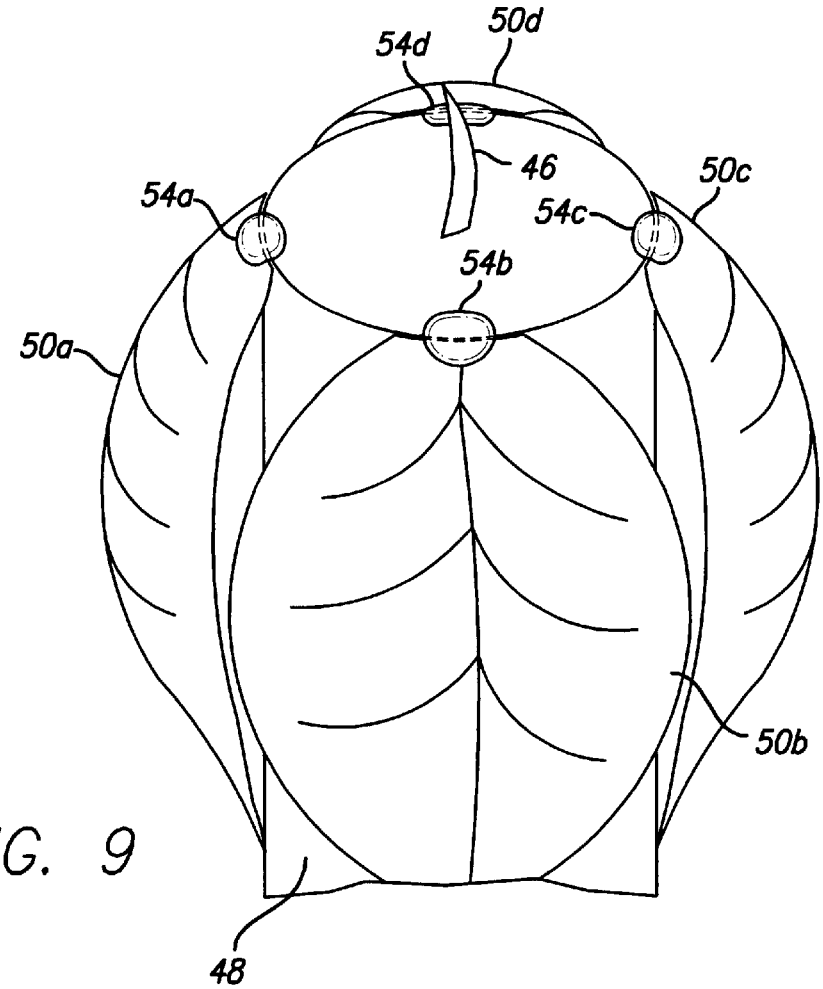

FIG. 9 depicts four attachments secured in the fashion depicted in FIG. 8.

Figure 10:
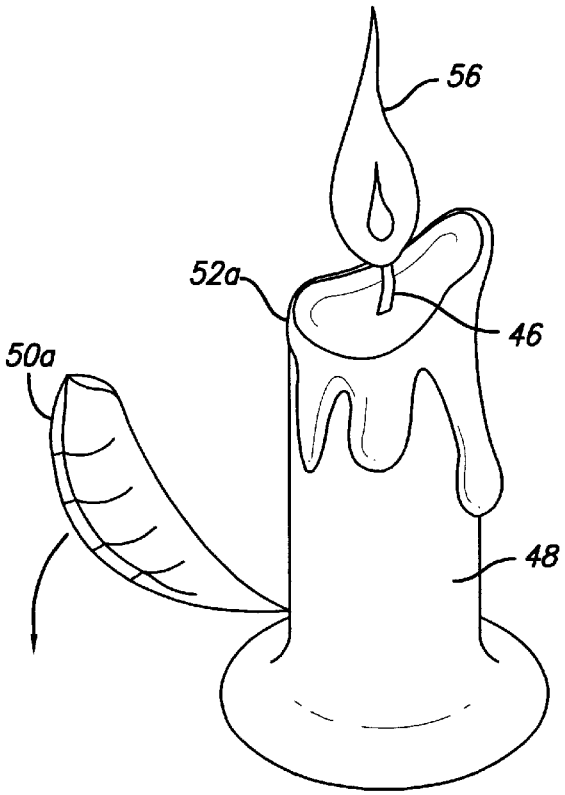

FIG. 10 depicts the attachment of FIG. 8 during the falling process.

Pin Bond

Figure 11:
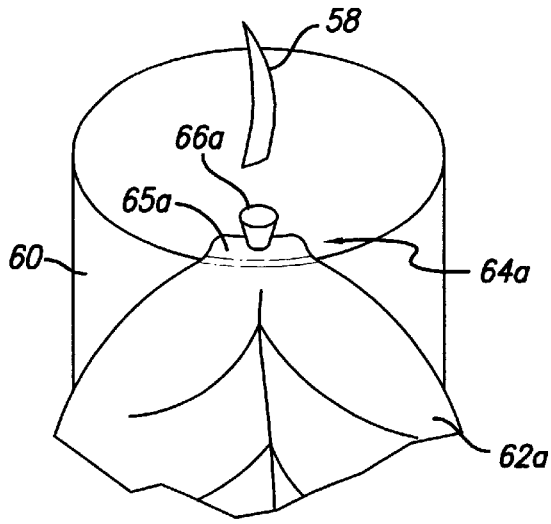

FIG. 11 depicts a front view of a top point of attachment where a pin is used to secure an attachment to the core.

Figure 12:
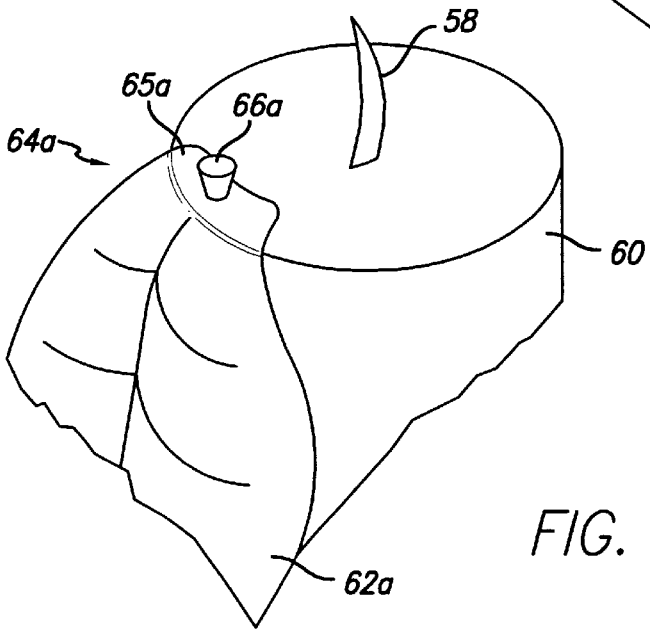

FIG. 12 depicts a side view of the attachment point of FIG. 11.

Figure 13:
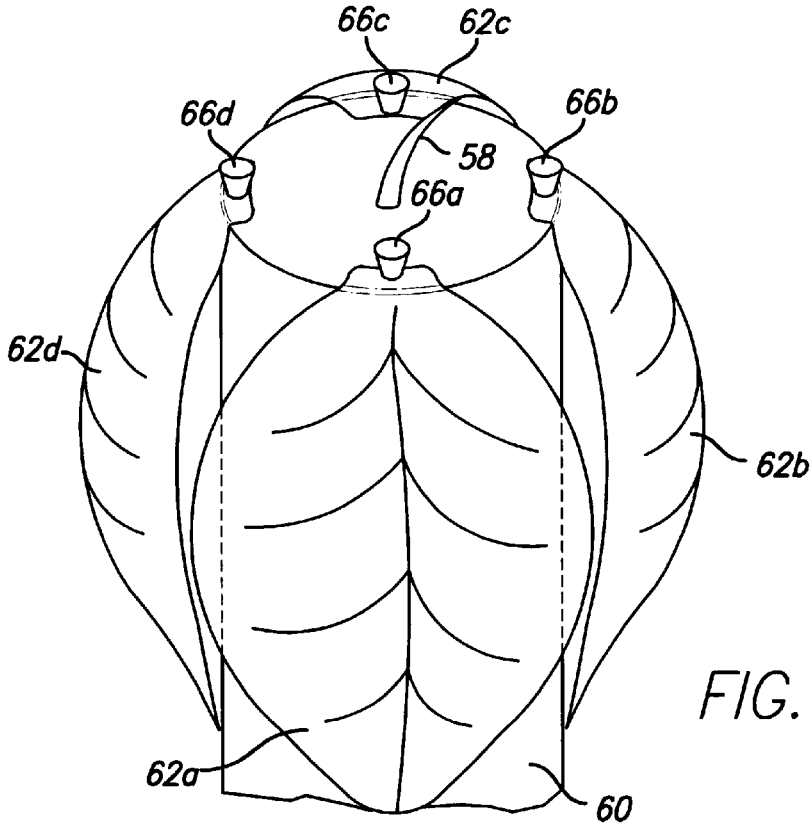

FIG. 13 depicts four attachments secured in the fashion depicted in FIG. 11.

Figure 14:
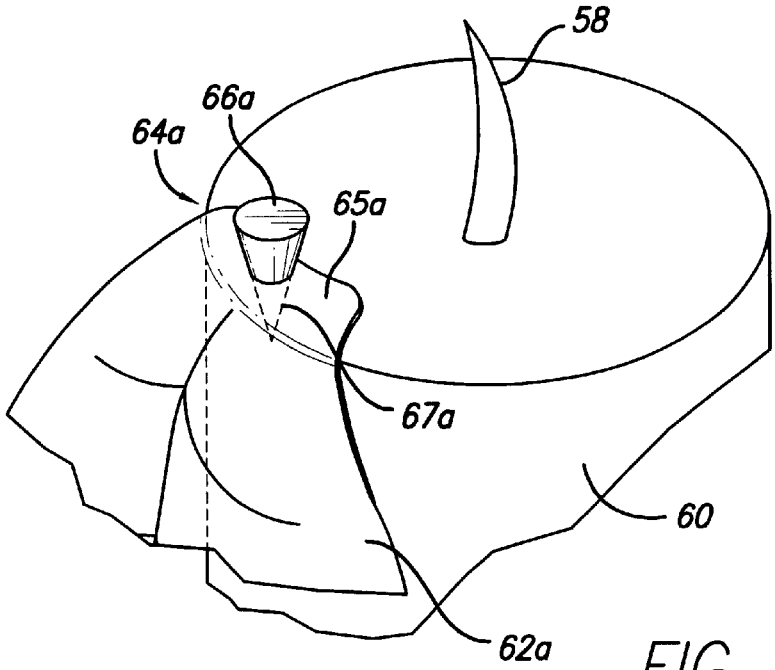

FIG. 14 depicts the attachment means of FIG. 12 in greater detail.

Wick Bond

Figure 15:
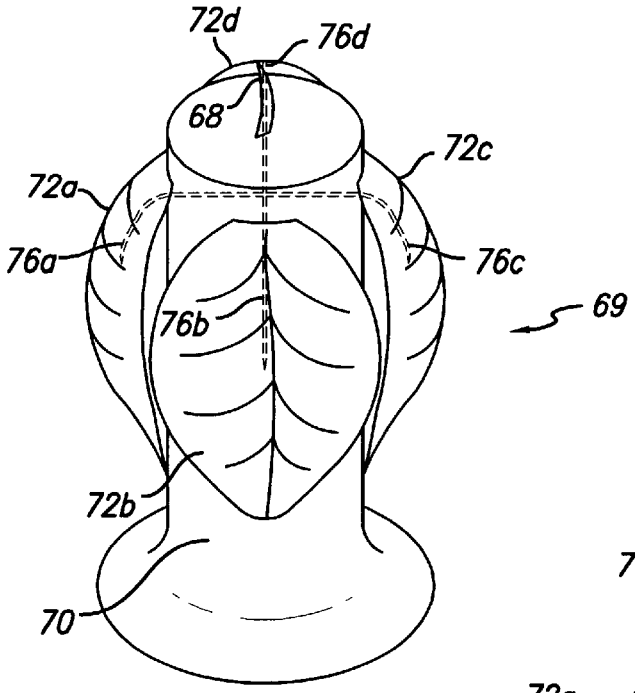

FIG. 15 depicts a candle where four embedded wicks are used to secure four attachments to the core.

Figure 16:
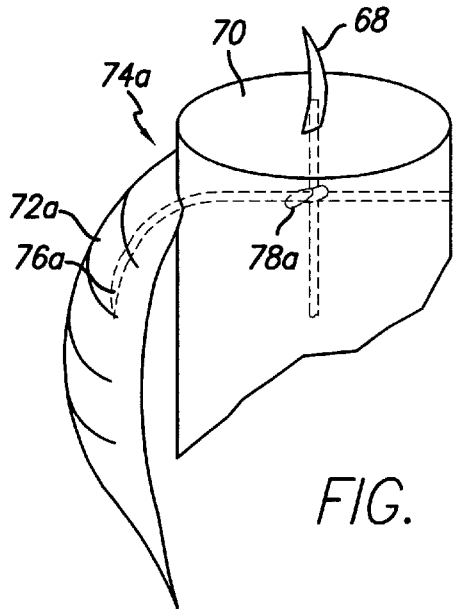

FIG. 16 depicts the embedded-wick attachment means of FIG. 15 in greater detail.

Figure 17:
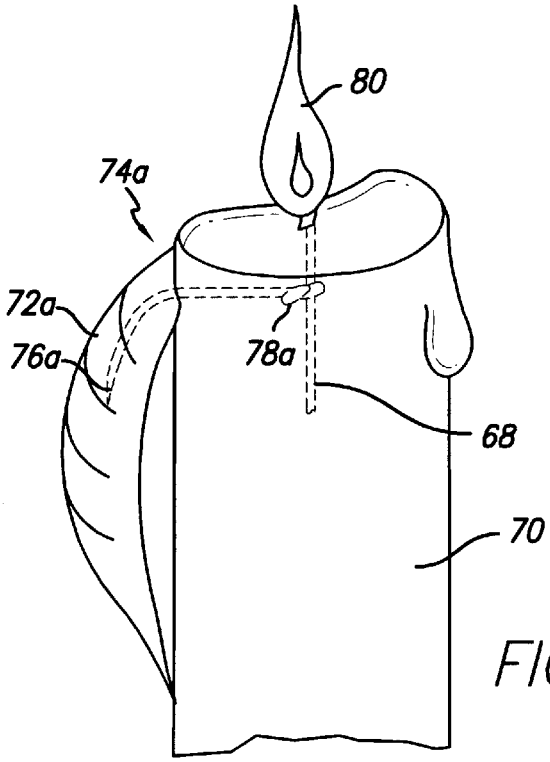

FIG. 17 depicts the candle of FIG. 16 after the main wick has been lit.

Figure 18:
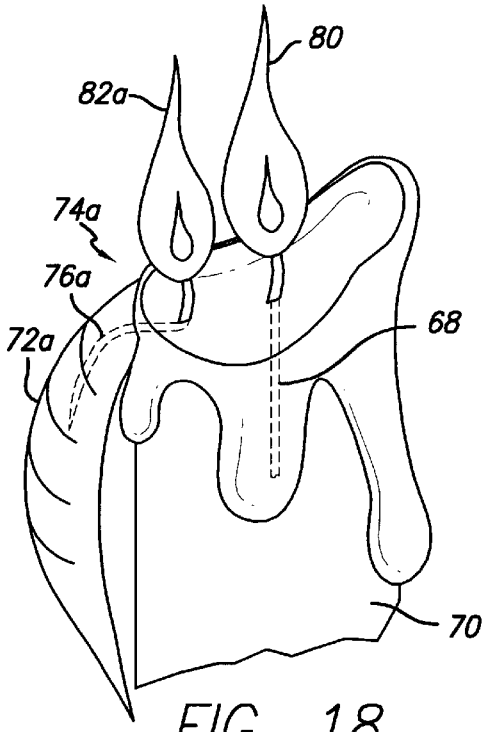

FIG. 18 depicts the candle of FIG. 16 after an embedded wick is lit by the main wick.

Figure 19:
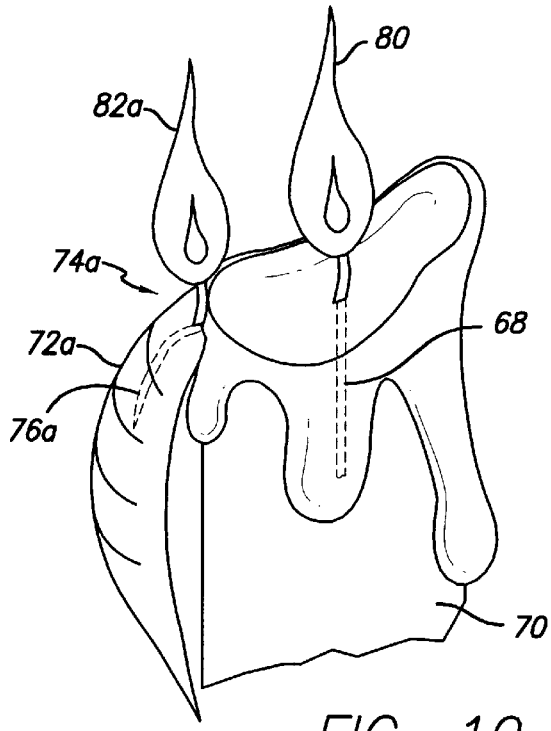

FIG. 19 depicts the candle of FIG. 16 after the embedded wick has burned to the top of the attachment.

Figure 20:
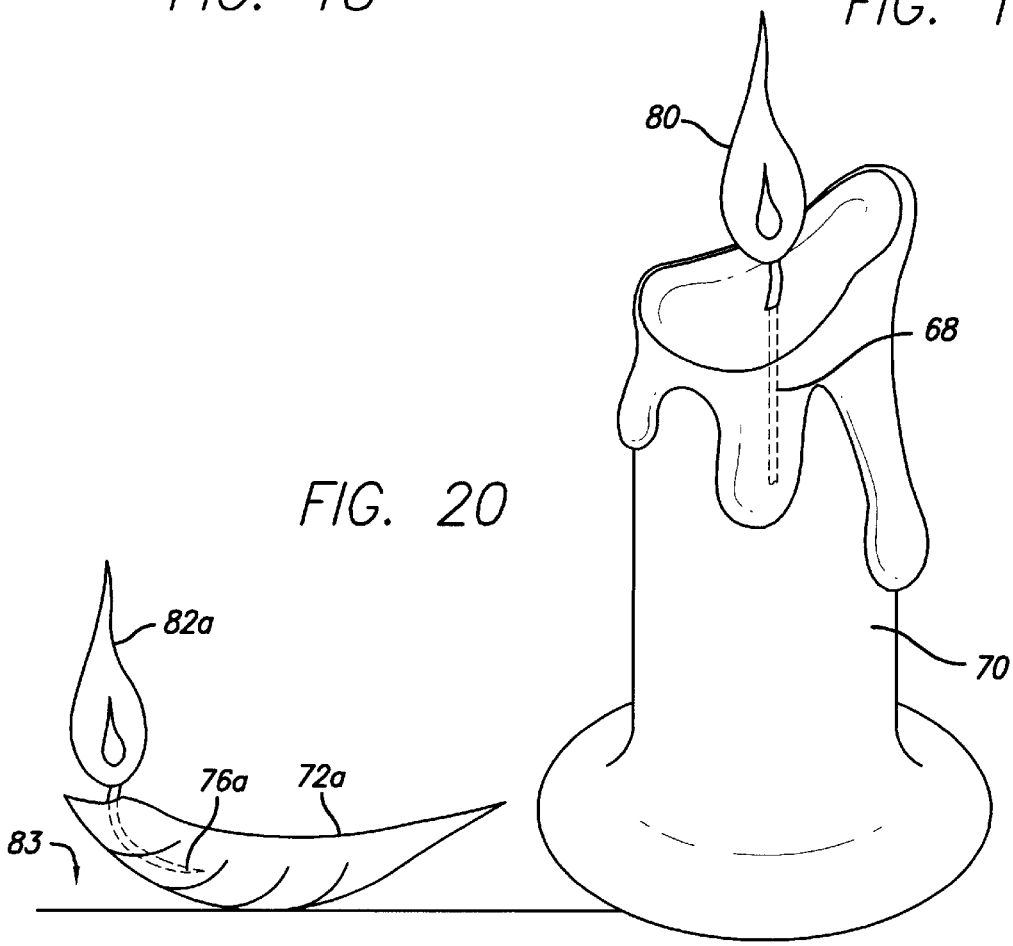

FIG. 20 depicts the candle of FIG. 16 once the attachment has fallen.

Figure 21:
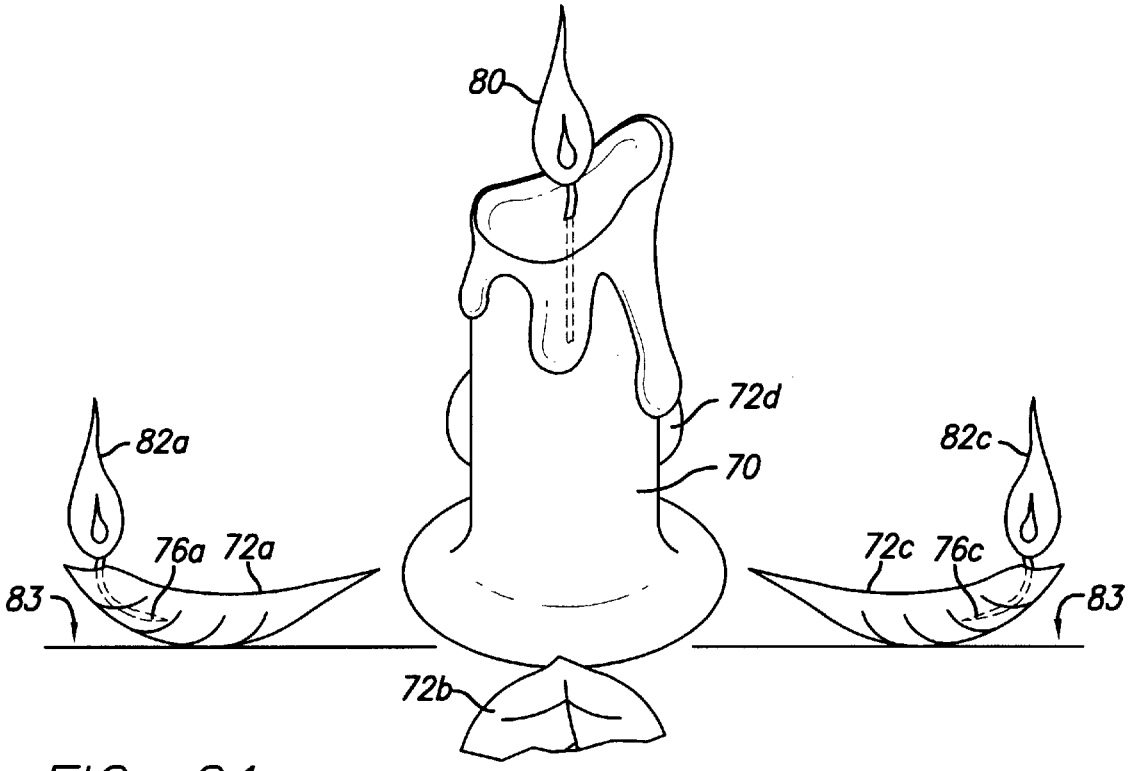

FIG. 21 depicts the candle of FIG. 15 once the four attachments have fallen.

Permutations of the First Embodiment

Nested

Figure 22:
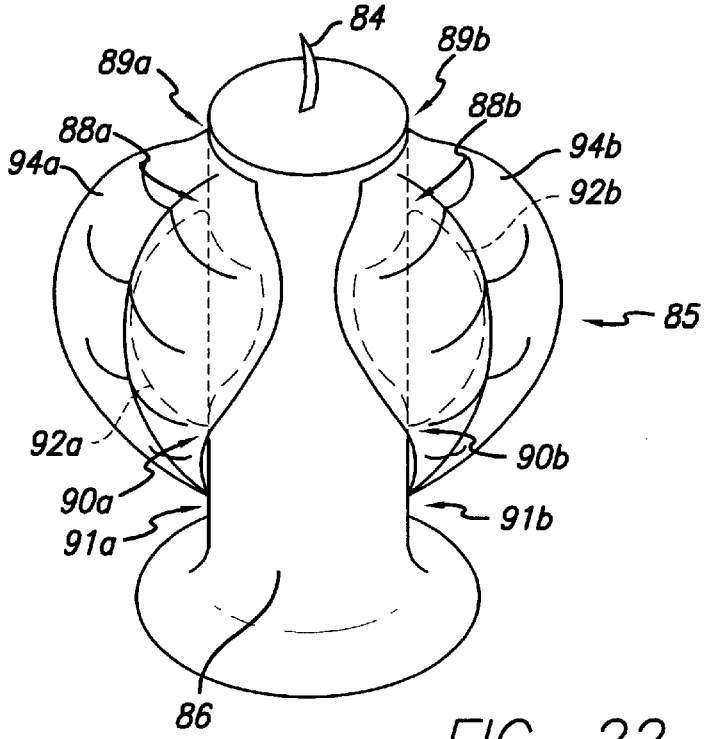

FIG. 22 depicts a novelty candle with attachments in a nested configuration.

Figure 23:
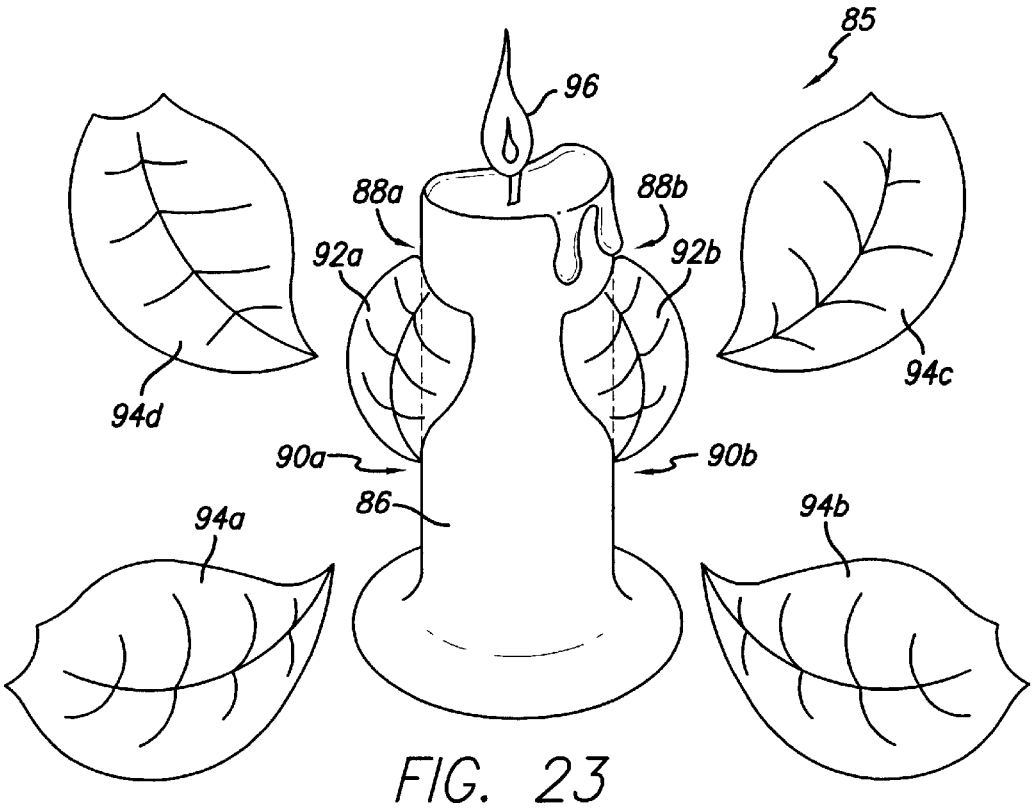

FIG. 23 depicts the candle of FIG. 22 after the first set of attachments has fallen.

Figure 24:
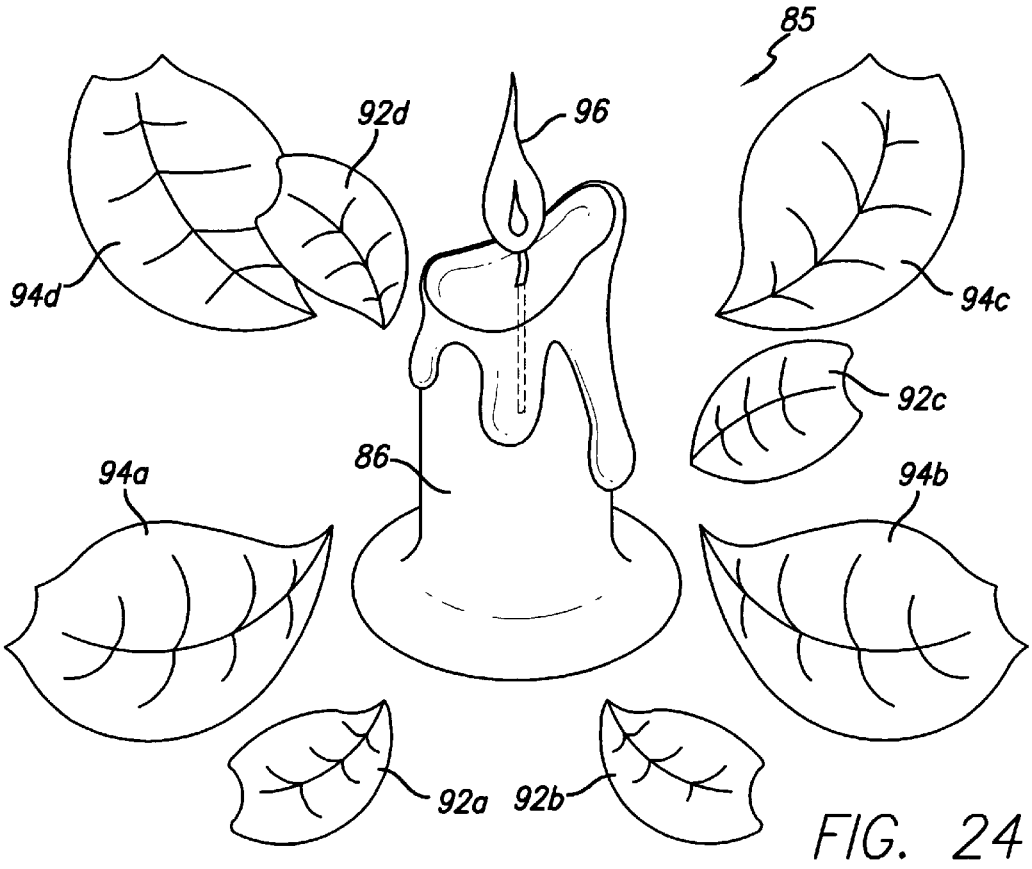

FIG. 24 depicts the candle of FIG. 22 after the final set of attachments has fallen.

Gift Item

Figure 25:
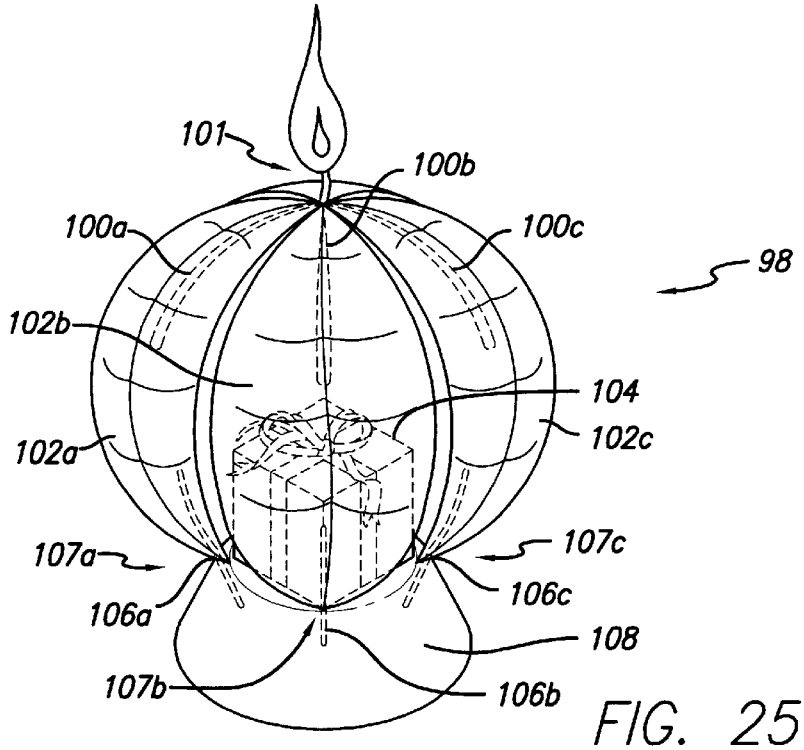

FIG. 25 depicts a novelty candle comprising a base and attachments surrounding a gift item.

Figure 26:
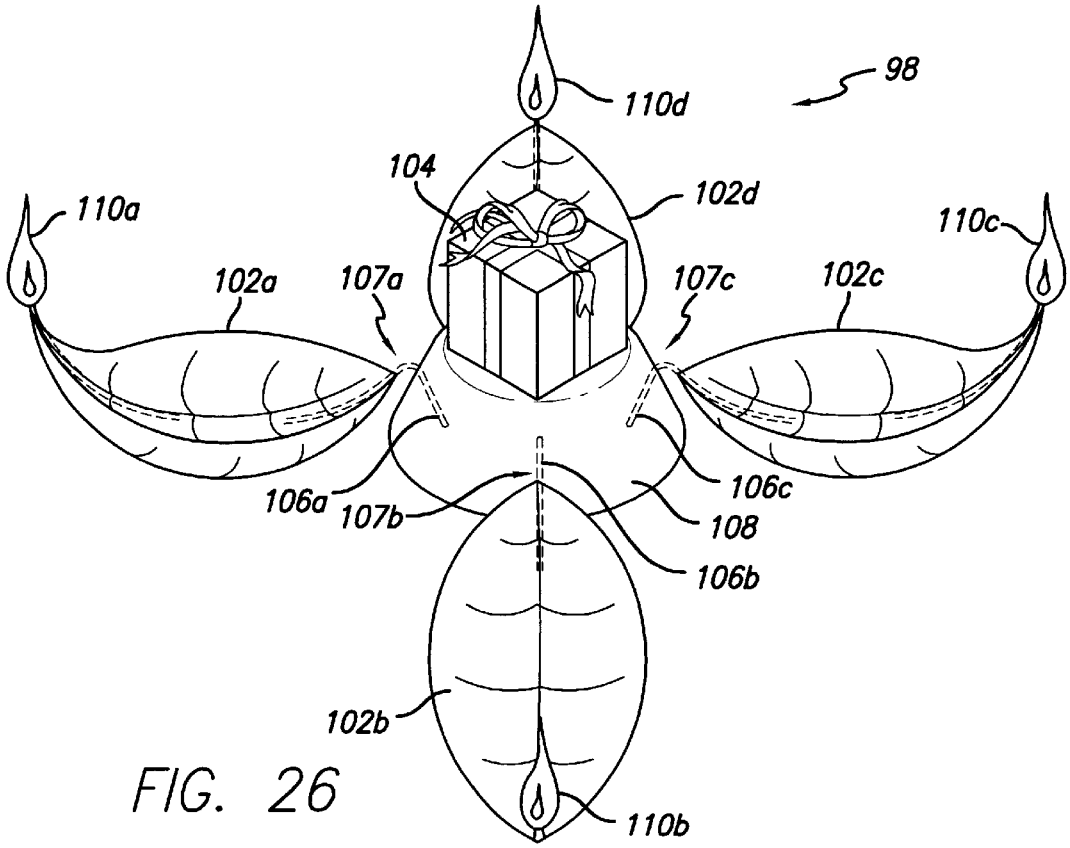

FIG. 26 depicts the candle of FIG. 25 after the attachments have fallen.

Figure 27:
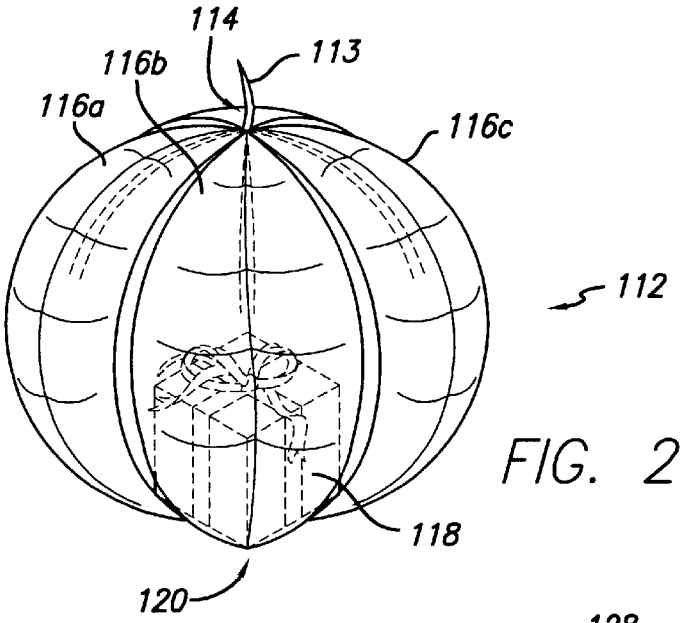

FIG. 27 depicts a novelty candle comprising four sections surrounding a gift item.

Figure 28:
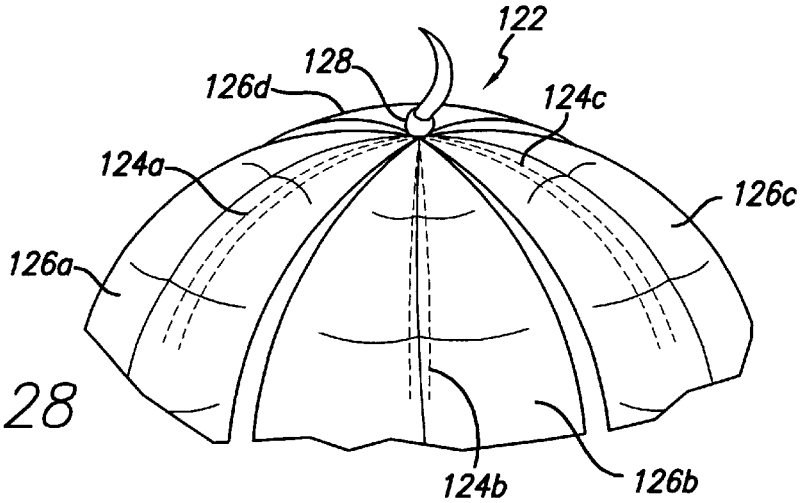

FIG. 28 depicts a twisted-wick attachment means.

Figure 29:
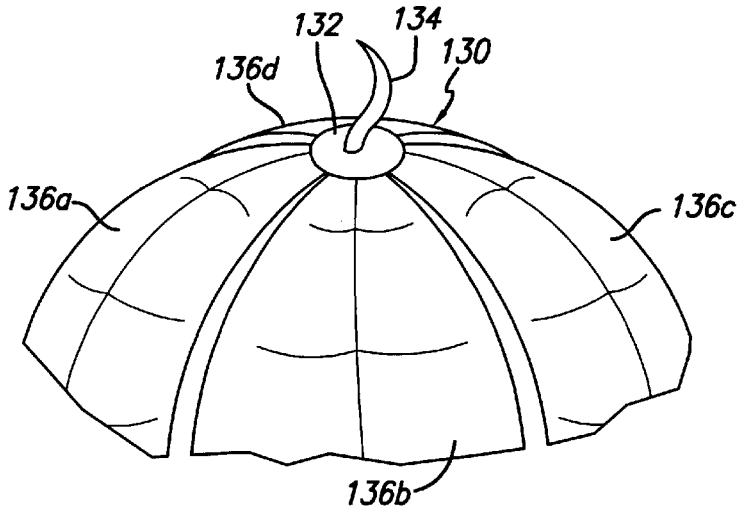

FIG. 29 depicts an added-wax-piece attachment.

Star

Figure 30:
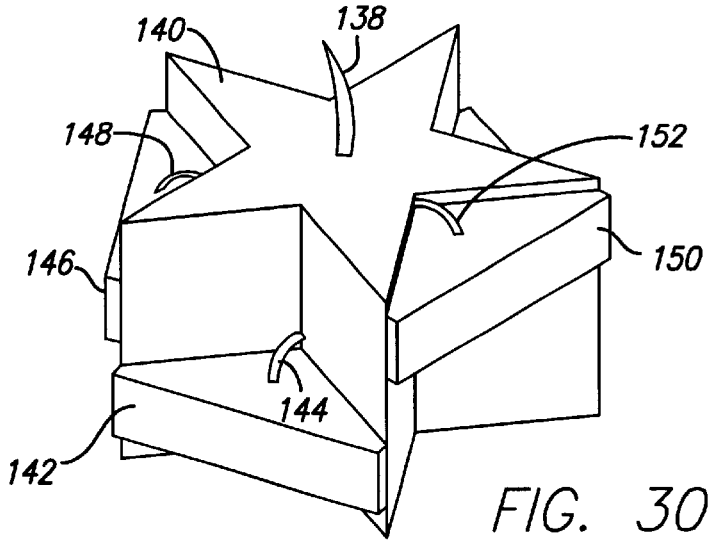

FIG. 30 depicts a star-shaped candle with several triangular-cross-section attachments.

Ball

Figure 31:
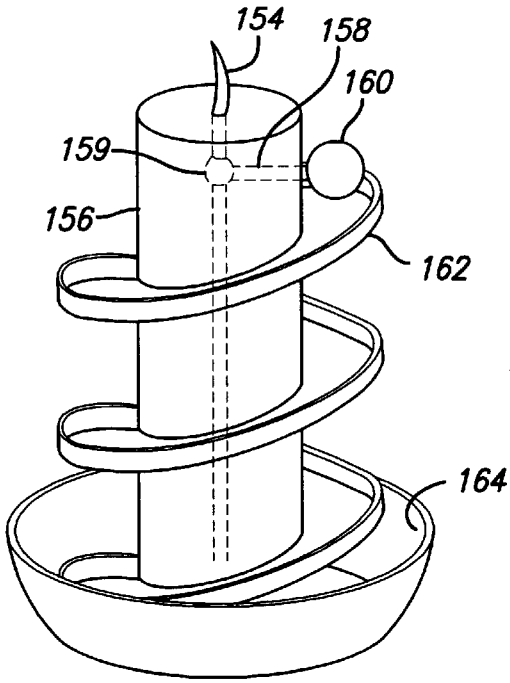

FIG. 31 depicts a novelty candle comprising an attachment in the shape of a ball and a core with a spiral path on which the ball may roll.

Shell Splitting

Figure 32:
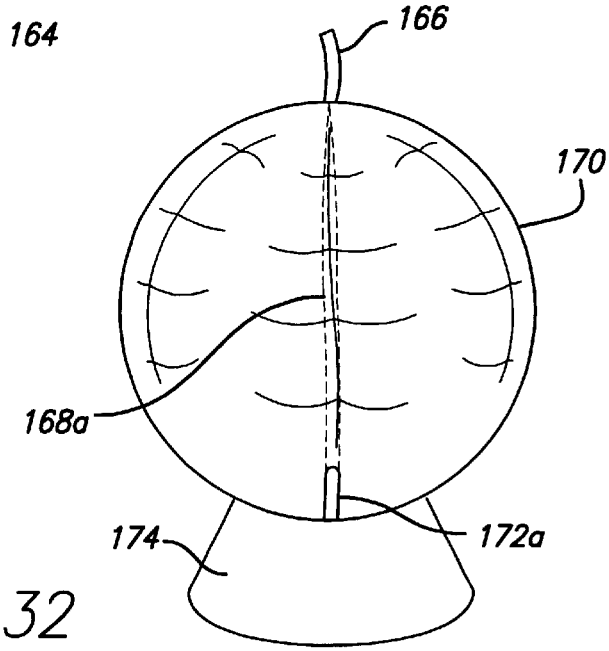

FIG. 32 depicts a candle comprising a single shell with embedded wicks.

Figure 33:
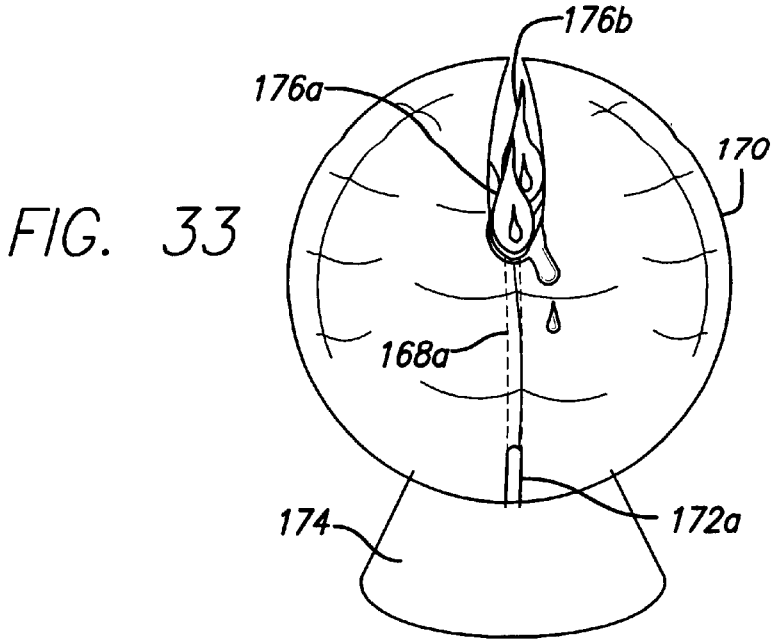

FIG. 33 depicts the candle of FIG. 32 in the midst of the burning process.

Figure 34:
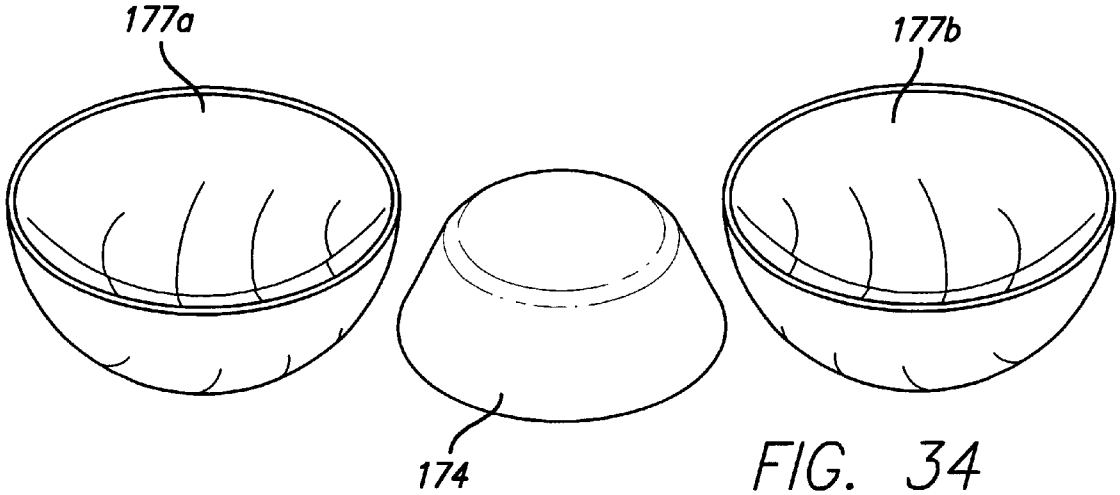

FIG. 34 depicts the candle of FIG. 32 after the burning process has completed.

Figure 35:
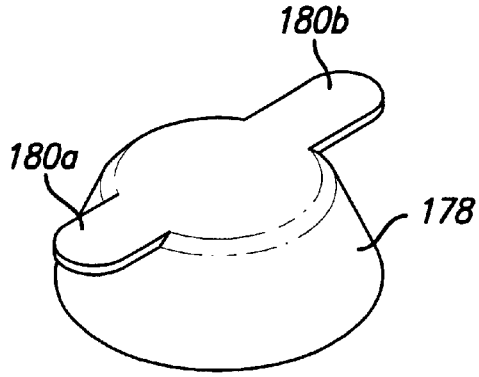

FIG. 35 depicts a lock-in mechanism for candles like that of FIG. 32.

Peapod

Figure 36:
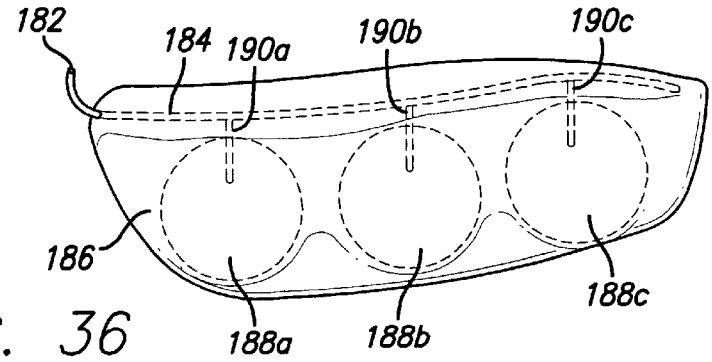

FIG. 36 depicts a pea-pod candle comprising a pod surrounding three peas.

Figure 37:
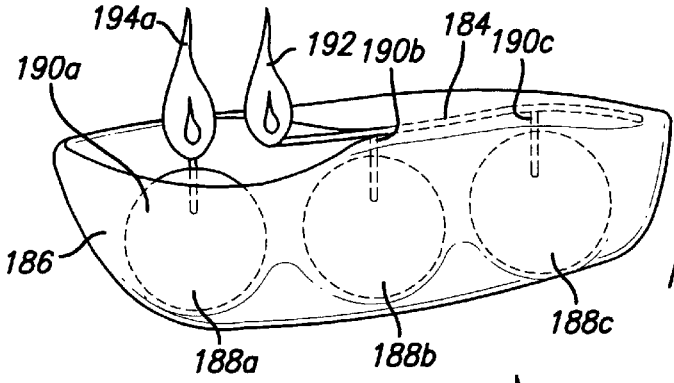

FIG. 37 depicts the candle of FIG. 36 after a main wick has lit the first pea.

Figure 38:
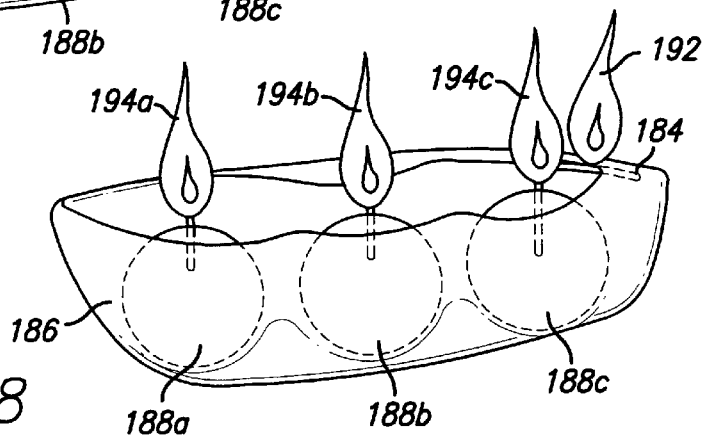

FIG. 38 depicts the candle of FIG. 36 after the main wick has lit all three peas.

Figure 39:
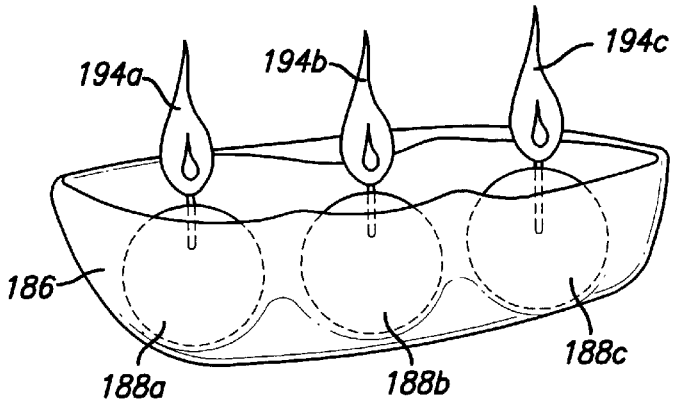

FIG. 39 depicts the candle of FIG. 36 with three lit peas after the main wick has extinguished.

DETAILED DESCRIPTION OF THE INVENTION

Figure 2:
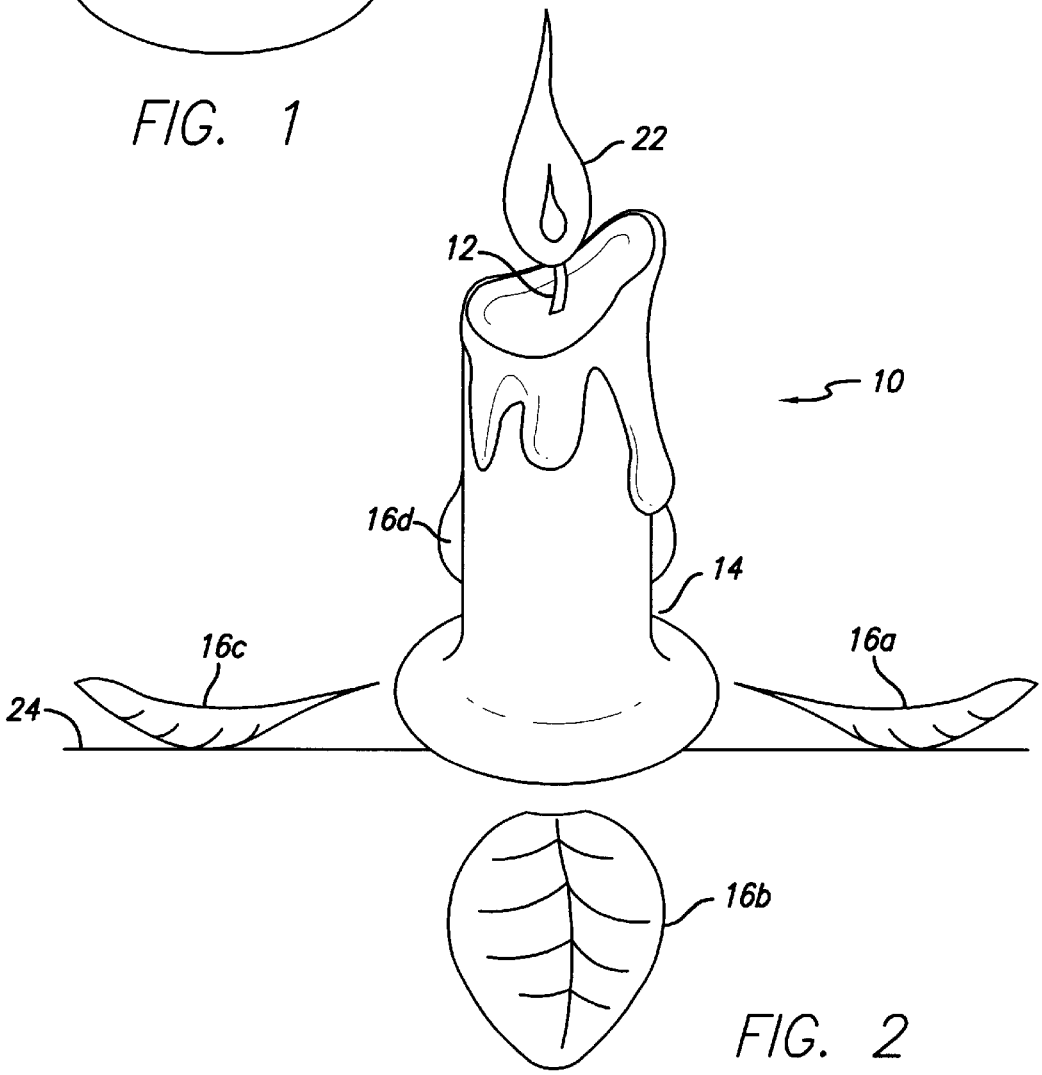
FIG. 2 depicts the novelty candle of FIG. 1 where the four attachments have fallen.

First Embodiment, FIGS. 1–2

One embodiment of the present invention is illustrated in FIG. 1. A novelty candle 10 has a wick 12 embedded in a wax core 14. Four attachments 16*a*, 16*b*, 16*c*, and 16*d* are evenly spaced around the core 14. The attachments 16*a*, 16*b*, 16*c*, and 16*d* can be secured to the core 14 at top points of attachment 18*a*, 18*b*, 18*c*, and 18*d* respectively through a variety of attachment means. The attachments 16*a*, 16*b*, 16*c*, and 16*d* are shaped, weighted, and placed such that they will fall down and outward resulting in a configuration such as that of FIG. 2. The falling process is initiated by lighting the wick 12. Heat from a flame 22 causes the attachments 16*a*, 16*b*, 16*c*, and 16*d* to disconnect at their respective top points of attachment 18*a*, 18*b*, 18*c*, and 18*d*. The attachments 16*a*, 16*b*, 16*c*, and 16*d* subsequently fall and rest on a table or other surface 24. Once the attachments 16*a*, 16*b*, 16*c*, and 16*d* have fallen, portions of the core 14 previously hidden are revealed. In the present example this is simply the side of the core but a wide range of possibilities are available. For instance, the side of the core 14 could be decorated with illustrations or the core 14 could be molded into interesting shapes.

The core 14 should be shaped such that a minimal amount of wax drips during the burning process on the bottom point of contact 20*b* as well as the other bottom points of contact which are obscured in FIG. 1. Such a design can ensure that the attachments 16*a*, 16*b*, 16*c*, and 16*d* do not inadvertently become fused to the core 14. The weight of the attachments 16*a*, 16*b*, 16*c*, and 16*d* should be sufficient to generate enough force to break any slight wax bonds that might remain holding the attachments 16*a*, 16*b*, 16*c*, and 16*d* to the core 14.

Bottom Attachment

Resting, FIG. 3

There are several different means of connecting the attachments 16*a*, 16*b*, 16*c*, and 16*d* to the core 14 at their bottoms. As illustrated in FIG. 3, the bottom points of contact 20*a* and 20*b* occur simply as a result of the attachments 16*a*, and 16*b* resting on the core 14. This leads to a falling pattern as depicted in FIG. 2. The attachments 16*a*, 16*b*, 16*c*, and 16*d* fall to the surface 24 a small distance from the core 14.

Wick, FIGS. 4–6

FIG. 4 depicts an alternative structure for a bottom contact point 34*a* in a similar novelty candle 26. In this case, an attachment 32*a* is connected to a core 30 with a small piece of wick 28*a*. This wick 28*a* acts as a hinge around which the attachment 32*a* can pivot. FIG. 5 depicts the attachment 32*a* after it has fallen. The attachment 32*a* remains connected to the core 30. FIG. 6 depicts the entire novelty candle 26 after the four attachments 32*a*, 32*b*, 32*c*, and 32*d* have fallen. The falling action is caused by the flame 36 which disconnects the attachments 32*a*, 32*b*, 32*c*, and 32*d* through a process described in the following "Top Attachment" section. The wick 28*a* can be embedded in the attachment 32*a* and the core 30 during a molding process or through some other means such as threading with a hot needle. The molding process can be a single or multi-step process. In a two step process, for example, the core 30 could be molded first with a properly placed additional wick 28*a*. A portion of the wick 28*a* should extend out of the core 30. This portion of wick not embedded in the core 30 will be embedded in the attachment 32*a* in a subsequent molding step. Note that a wick need not be used, a string or other material would work as well.

String, FIG. 7

Another means for connecting an attachment 40 to a core 38 at a bottom contact point 42 is depicted in FIG. 7. A loop of string 44 is threaded through the core 38 and attachment 40. The string 44 acts like a hinge, much like the wick 28*a* of FIG. 4. The string 44 can be threaded through the core 38 and attachment 40 using a hot needle or through some other means.

Top Attachment

Wax, FIGS. 8–10

One of the more critical features of the present invention is the top attachment points 18*a*, 18*b*, 18*c*, and 18*d* shown generally in FIG. 1. One means of attachment is illustrated in detail in FIG. 8. FIG. 8 depicts an attachment 50*a* fused to a core 48 with a wax bond 54*a*. FIG. 9 depicts four such attachments 50*a*, 50*b*, 50*c*, and 50*d* fused to the core 48. Note that the illustrations have a darkened wax bond for clarity only. The wax bond 54*a* can be created by a variety of different methods. One such method involves heating the attachment 50*a* and the core 48 at the top attachment point 52*a*. The heated components can be fused as depicted by applying pressure and allowing to cool in place. Alternatively, a small piece of wax could be heated and used to bind the attachment 50*a* to the core 48. Once the wick 46 is lit, heat from the flame 56 will melt the wax and eventually cause the wax bond 54*a* to break as illustrated in FIG. 10. This breakage will result in the attachment 50*a* falling down and outwards. This detachment and subsequent falling is one of the key components of the present invention. The length of time prior to breakage is variable. A longer duration could be obtained if the attachment 50*a* were bound to the core 48 at a greater distance from the main wick 46. In this scenario, the core 48 would first burn to the top attachment point 52*a* and the wax bond 54*a* would begin to melt, and eventually break. Again, it is critical that the attachment 50*a* be properly weighted, shaped, and placed such that it will fall outwards under the force of gravity, as in FIG. 10. The appropriate weight is dependent on the specific candle design, but in general it need be great enough to break any slight residual wax bonds. The shape and placement of the attachment must combine such that the attachment will in fact fall after the wax bond is broken, rather than continue to rest on the core. One additional consideration is the potential sliding of the attachment along the core from the top point of contact. If this is undesired, the attachment should be secured, for instance at the bottom, such that it will not slide down the core substantially and thus will be forced to fall outwards. One possible way of preventing undesired slipping is shaping the core at the bottom contact point such that a small nub prevents the attachment from sliding. The desired sliding of the attachment could be used to alter the manner in which the attachment falls.

Pin, FIGS. 11–14

Another means of top attachment is depicted in FIG. 11 and FIG. 12. In FIGS. 11 and 12, a pin 66*a*, is used to secure an attachment 62*a* to a core 60. Four such attachments are illustrated in FIG. 13. The pin 66*a*, can be composed of a variety of materials (e.g. metal or wood). If the pin 66*a*, is composed of a flammable material, care should taken to prevent a possible hazard. As indicated by the illustration in FIG. 14, the pin 66*a*, is tapered to a sharp point 67*a*. This allows the pin 66*a*, to be pushed through the attachment 62*a* and into the core 60 with a minimal amount of pressure. The wax of both the attachment 62*a* and the core 60 should be relatively warm when the pin 66*a*, is inserted to prevent cracking. The attachment 62*a* in FIG. 11 and 12 acts much the same as the attachment 50*a* of FIG. 8. In this case, however, the wax-surrounding-the-pin 65*a* melts rather than the wax bond 54*a* of FIG. 8. Once the wax has melted substantially, the attachment 62*a* is free to fall like the attachment 50*a* in FIG. 10. Please note that a variety of pin shapes, sizes, and materials are possible and those described are given as example and not intended to be limiting. The pins 66*a*, 66*b*, 66*c*, and 66*d* can be small enough to be virtually invisible or could be intentionally visible, with attractive additions at their tops like flowers, butterflies, or monster heads.

Wick, FIGS. 15–21

Yet another means of attachment is depicted in FIG. 15. A novelty candle 69 is comprised of a wick 68 embedded in a core 70. The core 70 is connected to four attachments 72*a*, 72*b*, 72*c*, and 72*d* each containing an attachment wick 76*a*, 76*b*, 76*c*, and 76*d*, respectively. FIG. 16 depicts a more detailed view of this attachment means. The attachment 72*a* contains embedded within itself an attachment wick 76*a*. The attachment wick 76*a*, is tied to the core wick 68 with a knot 78*a*. As illustrated, the attachment wick 76*a*, is embedded in both the attachment 72*a* and the core 70. This double embedding can be achieved by molding the core 70 with appropriately placed core wick 68 and attachment wick 76*a*, tied together. The attachment wick 76*a*, will protrude from the side of the core 70 much like the core wick 68 protrudes from the top of the core 70. The attachment 72*a* can then be molded around the attachment wick 76*a*. The result is a top attachment point 74*a* with a wick connector 76*a*. Please note that the attachment wick 76*a*, can be tied to the core wick 68 at any point along its length and is depicted in its present location for example only.

The burning process of such a candle 69 is illustrated in FIGS. 17–21. First the wick 68 is lit producing a core flame 80, as seen in FIG. 17. The candle burns down to the knot 78 that attaches the wicks 68 and 76*a*. It should be noted that the wicks should be relatively thin at this point so their combination is an appropriate size (to prevent an overly large flame from occurring). The attachment wick 76*a*, is lit by the flame 80. The attachment wick 76*a*, thereafter burns with its own flame 82*a* as shown in FIG. 18. The attachment flame 82*a* consumes the attachment wick 76*a*, until eventually it reaches the attachment as in FIG. 19. At this point the attachment 72*a* disconnects from the core 68. As shown in FIG. 20, the attachment 72*a* then falls and rests on a surface 83. The attachment 72*a* continues to burn independent of the core 68. The attachment wick 76*a*, can be of any desired length and therefore the attachment 72*a* can burn for a specified period of time. The combination of attachment wick 76*a*, length and placement and attachment 72*a* shape should be such that the attachment flame 82*a* will not contact the surface 83. FIG. 21 depicts four such attachments 72*a*, 72*b*, 72*c*, and 72*d* after they have fallen. The attachments need not be petal shaped as in FIGS. 15–21 but instead may be in the shape of animals, geometric figures, etc. The shape should be such that once the attachment has fallen it is able to act as an independent candle. In addition, the attachments could be arranged to fall in a specific pattern (e.g. to form a star).

Other Possibilities

The various attachment means at the top and bottom of the candle are given as examples only and are not intended to limit the scope of the invention. There are many other possible means of attachment. This invention is intended to cover, among other things, candles where attached sections fall after being released as a result of the burning process. The above attachment means can be combined and/or modified in a variety of ways. Some possibilities are illustrated in FIGS. 22–39.

Nested, FIGS. 22–24

FIG. 22 depicts a novelty candle 85 with attachments 92*a* and 92*b*and 94*a* and 94*b* in a nested configuration. The attachment means at the top attachment points 88*a* and 88*b* and 89*a* and 89*b* is intentionally left unspecified as any suitable means can be used. The outer attachments 94*a* and 94*b* have top attachment points 89*a* and 89*b* closer to the top of the core 86. The outer attachments 94*a* and 94b surround the inner attachments 92*a* and 92*b* and the core 86. Once the wick 84 is lit the candle burns until the flame 96 reaches the top points of attachment 89*a* and 89*b*. The flame 96 acts to disconnect the outer attachments 94*a* and 94*b* as in any of the methods described earlier or through some alternative means. FIG. 23 illustrates the candle 85 after the first set of attachments 94*a*, 94*b*, 94*c*, and 94*d* has fallen. The candle 85 continues to burn to the top point of attachment 88*a* and 88*b* of the inner attachments 92*a* and 92*b*. At this point the flame 96 disconnects the inner attachments 92*a*, 92*b*, 92*c*, and 92*d*. FIG. 24 depicts the candle 85 once all the attachments 92*a*, 92*b*, 92*c*, and 92*d* and 94*a*, 94*b*, 94*c*, and 94*d* have fallen.

Gift Item, FIGS. 25–29

FIG. 25 and FIG. 26 depict another modification. A candle 98 is comprised of a base 108 and four attachments 102*a*, 102*b*, 102*c*, and 102*d*. The four attachments 102*a* , 102*b*, 102*c*, and 102*d* surround a gift item 104 which rests on the base 108. It may be desirable to secure the gift item 104 to the base 108. Note that the attachments 102*a*, 102*b*, 102*c*, and 102*d* can be fitted such that the gift item 104 is not visible from the exterior. The attachments 102*a*, 102*b*, 102*c*, and 102*d* can be connected to the base 108 using bottom attachment wicks 106*a*, 106*b*, and 106*c* as illustrated (with the fourth attachment wick not shown) or using some other means. There are several means for connecting the attachments 102*a*, 102*b*, 102*c*, and 102*d* at the top 101. One such means is illustrated in FIG. 28. The attachments 126*a*, 126*b*, 126*c*, and 126*d* each contain an attachment wick 124*a*, 124*b*, 124*c*, and 124*d*. The attachment wicks 124*a*, 124*b*, 124*c*, and 124*d* are tied together with a knot 128. Alternatively the attachment wicks 124*a*, 124*b*, 124*c*, and 124*d* could simply be twisted together. This yields what appears to be a single wick at the top attachment point 122. Generally, this wick will be thicker than desired. To avoid this problem the exposed portion (that is not covered with wax) of each wick can be unraveled and part of it cut away. Alternatively, the wicks could be of variable thickness—relatively thick where embedded in the attachment and thinner where not. The thinner wicks can then be twisted together. A drop of molten wax can be used to bind the twisted wicks together. Another alternative is illustrated in FIG. 29. A small piece of wax 132 containing a wick 134 is fused to the four attachments 136*a*, 136*b*, 136*c*, and 136*d*. The fusion process can be achieved by heating the top of the attachments 136*a*, 136*b*, 136*c*, and 136*d* and added wax 132 and pressing together. Yet another alternative uses a single attachment containing a wick with the remaining attachments fused to it. Yet another alternative uses a piece of string to tie the attachment wicks together. The overly thick wick problem can be addressed as described earlier.

Regardless of the top means of attachment, a flame will act to disconnect the attachments 102*a*, 102*b*, 102*c*, and 102*d* of FIG. 25. It may be desirable to create a well at the very top of the candle where the sections come together. A well in this case is intended to mean an area where molten wax will pool. The well could be made by having the attachments slope downward at their very top. The well is intended to prevent molten wax from falling in undesired areas (e.g. the bottom attachment points). In this case it is more desirable to have the molten wax drip on the base. Once the attachments 102*a*, 102*b*, 102*c*, and 102*d* are disconnected, they fall as in FIG. 26. The gift item 104 is now completely visible and the attachments 102*a*, 102*b*, 102*c*, and 102*d* act as independent candles. Note that the candle 98 can be designed so a consumer could place any gift item 104 on the base 108 and then seal the attachments together at the top. FIG. 27 depicts a candle 112 similar to candle 98 of FIG. 25. Candle 112 has no base, the gift item 118 rests on the four attachments 116*a*, 116*b*, 116*c*, and 116*d* . The four attachments 116*a*, 116*b*, 116*c*, and 116*d* can be linked together at the bottom attachment point 120 by twisting or tying wicks together or fusing wax together. The bottom of the four attachments 116*a*, 116*b*, 116*c*, and 116*d* need to be shaped such that the candle 112 is able to stand upright. Note that the length of time from when the candle is lit and when the attachments fall can be adjusted. A longer duration simply requires a longer or thicker wax section above the point where the attachments come together. For instance, the disk-shaped added wax 132 of FIG. 29 could be a cylinder rising upwards.

Star, FIG. 30

Another possible candle type is illustrated in FIG. 30. FIG. 30 depicts a star-shaped core 140 with five triangular attachments, three of which 142, 146, and 150 are visible. The attachments 142, 146, and 150 are connected to the core 140 with attachment wicks 144, 148, and 152 respectively. The wick attachment means is the same as illustrated in FIGS. 15–19. The attachments 142, 146, and 150 should be wide enough at their bottoms that they are able to stand independently after they are disconnected. As in the candles described earlier, the attachments 142, 146, and 150 are disconnected as a result of the burning process. In this case, the attachments 142, 146, and 150 are connected only at the top and fall down only, rather than down and outward. The attachments will fall in the order 150, 146, 142, the closest to the top (150 in this case) falling first. Once the attachments 142, 146, and 150 have fallen they will burn as independent candles. This type of candle offers the possibility of a timing feature. For example, each attachment could fall approximately half an hour after the previous and each attachment could burn for a specified number of minutes. Again, a potential difficulty is undesired binding of the attachments 142, 146, and 150 to the core 140 with molten wax. Care should be taken to prevent this by appropriate sizing of the core wick 138 (to prevent excessive molten wax from developing) as well as the other measures described earlier such as having attachments with great enough weight to break slight wax bonds. Note that the weight of the attachments is not a large concern if the molten wax is not allowed to form any bonds at all.

Ball, FIG. 31

The design potential can be extended even further. FIG. 31 depicts a candle comprising a core 156 with a downward spiraling ramp 162. The core 156 is connected to a ball 160. The connection is made by tying the ball or attachment wick 158 in a knot 159 around the main wick 154. This candle operates in a fashion similar to the star candle of FIG. 30.

The main distinction with prior examples is that when the ball 160 detaches it will not simply fall to a surface but instead will roll down the spiral ramp 162 and eventually rest on a base 164. The potential detachment methods are identical to those described earlier wherein the core wick is lit and the subsequent flame acts to disconnect the attachment. Care must be taken so molten wax does not fall on the ramp 162 where it can act to impede the motion of the ball 160. A groove for the molten wax could be created on the ramp, adjacent to the core allowing the ball to avoid contact with the molten wax. The above example describes only one of the many types of motions that attachments can undergo during and after the falling process.

Shell Splitting, FIGS. 32–35

Yet another design extension involves the addition of a step prior to an attachment falling. FIG. 32 illustrates a single shell 170 resting on a base 174. An embedded wick 168*a* runs in a semicircle within the shell 170. A second embedded wick (not shown) runs on the opposite side of the shell 170. The embedded wick 168*a* and the second embedded wick, which is not shown, are placed such that they will split the shell 170 into two sections 177*a* and 177*b* as in FIG. 34. FIG. 33 illustrates an intermediate stage of the burning process. Lighting the exposed wick portion 166 acts to light the embedded wicks 168*a* and 168*b*. The embedded wicks 168*a* and 168*b* slice through the shell 170. The slicing rate is determined by the thickness of the shell 170. A thicker shell yields a slower rate. Once a notch 172*a* and a second notch on the opposite side of the shell (not shown) are reached the shell 170 is split completely and the two halves 177*a* and 177*b* fall as in FIG. 34. The notches 172*a* and the second not shown are used to prevent the flames 176*a*, and 176*b* from contacting the base 174 and fusing it to the shell 170. One of the main difficulties with this slicing process is dripping wax. Dripping wax has a tendency to bind the shell 170 to the base 174 at the bottom, preventing the newly formed sections from disconnecting. This binding problem can be avoided by properly shaping the base to catch any dripping wax.

This single shell design allows a base to be locked into the shell. One possible lock-in mechanism is depicted in FIG. 35. A base 178 is shaped with two protrusions 180*a* and 180*b* that fit into similarly shaped gaps in a shell. The base 178 can thus be slipped through the shell and turned 180 degrees to lock the core or base in place.

Note that two embedded wicks have been used as an example only and more than two can be used. In addition, a wick-containing core could be substituted for the base in the examples above. The core would then continue to burn after the shell had split. The only additional requirement is that the core wick be connected to or adjacent to the embedded wicks. One way that this can be achieved is by drilling a small hole at the very top of the shell, adjacent to the embedded wicks, and threading the core wick through the shell.

Peapod, FIGS. 36–39

Yet another feature can be added in addition to the slicing mechanism. FIG. 36 depicts a peapod candle, wherein a slicing or embedded wick 184 serves to split the pod 186 and also acts to light additional wicks 190*a*, 190*b*, and 190*c*. The exposed portion of the slicing wick 182 is lit first. As in FIG. 37 the slicing or main wick 184 splits the pod 186 starting at one end. The main flame 192 lights the first pea wick 190*a* and a pea 188*a* then continues to burn with its own flame 194*a*. The main flame 192 eventually reveals and lights all three peas 188*a*, 188*b*, and 188*c* as seen in FIG. 38. The peas 188*a*, 188*b*, and 188*c* thereafter burn independently. The main flame 192 continues to burn until the end of the main wick 184 is reached and then is extinguished as in FIG. 39. The three peas 194*a*, 194*b*, and 194*c* continue to burn within the pod 186. In this example the shell did not fall open but an interesting and new result has still been achieved. Previously hidden components, the peas 188*a*, 188*b*, and 188*c*, were lit and revealed by a main wick 184. It is possible to design the candle such that the pod falls open. The pod could be severed at the bottom, thus when the top is split the pod will fall open. However, care must be taken to avoid wax dripping on the bottom of the pod as it will bind the pod together and to the surface on which it rests. Additionally, the peas should be elevated within the pod and their bottoms should not rest on the pod. The peas will eventually fall onto the pod, aiding the splitting process.

One means of creating this type of candle involves wrapping the peas in a thin, square sheet of wax containing an embedded wick. The pea wicks are pressed adjacent to the main embedded wick within the square sheet. The sheet is wrapped around the peas. The open end of the pod is then pressed together and cut to shape.

Conclusion, Ramifications, and Scope of the Invention

The various candles, attachment means, and other details described above illustrate many of the possibilities available using this new invention. A variety of structures were presented including: a candle structure comprised of one or more attached sections that fall away as the candle burns; a candle with multiple wicks where additional wicks are used to detach candle sections; a candle that develops into multiple burning candles as a result of sections falling and continuing to burn with their own wicks; top attachment means including wick, wax, and pin; bottom attachment means including wick, string, and resting; candle structures such that hidden components are revealed as the candle burns; a candle with sections attached in a nested configuration; a clock-type candle where falling sections indicate the passage of time; candles with sections that fall and then continue to move, such as rolling balls; a candle consisting of attached sections that fall to reveal a gift item.

The examples given should not be construed as limitations, clearly many other possibilities exist. Any combinations of attachments or attachment means can be used and the attachment means can be other than those described. For instance, attached balls could be combined with nested petals. Different scents could be added to falling pieces to produce unique changing scent combinations (i.e. scented wick-containing attachments would add a new scent once they were lit by the core wick). In addition, fallen sections could burn with different color flames. Attachments need not be evenly spaced around the core nor at the same height. For gift-item type candles it is possible to design the candle so that a consumer could later add a gift item and seal the candle him or herself. Also, not all of the candle components need to be made of wax. For instance, falling bells could be used as attachments or a ceramic base could be used rather than a wax one. In an extreme case, only a small wax seal containing a wick could be used to hold ceramic (or some other material) attachments together. The only components that need to be wax or wax-like substances are those containing a wick. In addition, the attachments, whether wax or not, can be virtually any shape desired as can the core or base. Examples of aesthetically pleasing designs include: flower petals that fall off; an egg shell that falls apart to simulate the hatching of a dinosaur, chick, or other creature; a peapod that falls apart to reveal several peas inside; an oyster shell that falls apart to reveal a pearl inside; a clam shell that falls apart to reveal Venus inside; an apple that falls apart to reveal a worm inside; a stone that falls apart to reveal crystals inside (i.e. a wax geode); a branch that falls off a tree to reveal a squirrel; a flower that falls open to reveal an engagement ring; wax tears that fall off a face-shaped candle; a guillotine candle where a blade falls to simulate the removal of a head.

In general, the above examples can be combined in a variety of ways to produce different candle designs. In many cases the manufacture of the candles can be achieved with a single molding process. In others a multistage molding process could be used. However, any manufacture method which achieves candles with sections that fall away and/or reveal previously hidden components can be used to create candles of this type.

We claim:

1. A candle comprising one or more attachments connected around a wick, said one or more attachments defining a space suitable for enclosing a gift item; wherein lighting the wick generates a flame and said flame causes simultaneous displacement of an entirety of at least one of said one or more attachments, thereby providing access via the displacement to the space.

2. The candle of claim 1 wherein the wick is embedded within one of said one or more attachments.

3. The candle of claim 1 wherein the one or more attachments includes two or more attachments; and wherein the wick is a main wick comprised of at least two attachment wicks that are bound together; and wherein said at least two attachment wicks are embedded respectively within the two or more attachments.

4. The candle of claim 1 wherein the one or more attachments includes two or more attachments, and each of the two or more attachments has an upper portion adjacent to the wick and a lower portion at which the two or more attachments are connected to one another.

5. The candle of claim 1 wherein each of the one or more attachments has an upper portion adjacent to the wick and a lower portion connected to a base.

6. The candle of claim 1 wherein the at least one of said one or more attachments burns independently after the displacement.

7. The candle of claim 1 wherein the wick is embedded within a piece of wax to which the one or more attachments are bound.

8. A candle comprising one or more attachments each of which has an upper portion and a lower portion, wherein the one or more attachments are connected around a wick at the upper portion and to a base at the lower portion, said one or more attachments defining a space suitable for enclosing a gift item; wherein lighting the wick generates a flame and said flame causes simultaneous displacement of an entirety of at least one of said one or more attachments, thereby providing access via the displacement to the space.

9. The candle of claim 8 wherein the wick is embedded within one of said one or more attachments.

10. The candle of claim 8 wherein the one or more attachments includes two or more attachments; and wherein the wick is a main wick comprised of at least two attachment wicks that are bound together; and wherein said at least two attachment wicks are embedded respectively within the two or more attachments.

11. The candle of claim 8 wherein the at least one of said one or more attachments burns independently after the displacement.

12. The candle of claim 8 wherein the wick is embedded with a piece of wax to which the one or more attachments are bound.

13. The candle of claim 8 wherein the one or more attachments are connected to the base using a flexible material.

14. The candle of claim 13 wherein the at least one of said one or more attachments burns independently after the displacement.

15. A method of using a candle comprising the steps of:

(a) providing the candle, which comprises one or more attachments connected around a wick, said one or more attachments defining a space suitable for enclosing a gift item;

(b) lighting the wick to generate a flame;

(c) allowing said flame to cause simultaneous displacement of an entirety of at least one of said one or more attachments;

(d) providing access via the displacement to said space.

16. The method of claim 15 with the added step of allowing the at least one of said one or more attachments to burn independently after the displacement.

17. The method of claim 15 wherein the one or more attachments are connected around the wick using one or more of the group composed of wax bond, pin, and connecting wick.

18. The method of claim 15 wherein each of the one or more attachments has an upper portion adjacent to the wick and a lower portion at which the one or more attachments are connected to one another.

19. The method of claim 15 wherein each of the one or more attachments has an upper portion adjacent to the wick and a lower portion connected to a base.

20. The method of claim 15 wherein the one or more attachments includes two or more attachments; and wherein the wick is a main wick comprised of at least two attachment wicks that are bound together; and wherein said at least two attachment wicks are embedded respectively within the two or more attachments.

* * * * *